United States Patent [19]

Ota et al.

[11] 4,391,381

[45] Jul. 5, 1983

[54] PAINT-COATED BOTTLE

[75] Inventors: Akiho Ota; Fumio Negishi, both of Tokyo, Japan

[73] Assignee: Yoshino Kogyosho Co., Ltd., Tokyo, Japan

[21] Appl. No.: 351,393

[22] Filed: Feb. 22, 1982

Related U.S. Application Data

[63] Continuation-in-part of Ser. No. 253,635, filed as PCT JP79/00206, Aug. 3, 1979, published as WO81/00391, Feb. 19, 1981, § 102(e) date Mar. 3, 1980, abandoned.

[30] Foreign Application Priority Data

Feb. 2, 1978 [JP] Japan ..... 53-12368

[51] Int. Cl.[3] ..... B65D 23/00

[52] U.S. Cl. ..... 215/1 C; 428/35; 428/483

[58] Field of Search ..... 215/1 C; 428/35, 483

[56] References Cited

U.S. PATENT DOCUMENTS

| | | | |
|---|---|---|---|
| 2,985,542 | 5/1961 | Pinsky et al. | 215/1 C |
| 3,547,294 | 12/1970 | Williams | 215/1 C |
| 4,069,933 | 1/1978 | Newing | 215/1 C |
| 4,208,468 | 6/1980 | Cunningham et al. | 428/483 |

*Primary Examiner*—William R. Dixon, Jr.
*Attorney, Agent, or Firm*—Parkhurst & Oliff

[57] ABSTRACT

The present invention relates to a bottle formed of a saturated polyester resin, and to a method of coating the bottle with a decorative paint coating adapted to adhere to the bottle without peeling. The decorative coating is prepared by coating the bottle in sequence with a primer layer, an undercoat layer, a decorative paint layer, and a protective top coat layer.

3 Claims, 2 Drawing Figures

PAINT-COATED BOTTLE

CROSS-REFERENCE TO RELATED APPLICATION

This application is a continuation-in-part application of copending U.S. Ser. No. 253,635, filed as PCT JP79/00206, Aug. 3, 1979, published as WO81/00391, Feb. 19, 1981, § 102(e) dated Mar. 3, 1980 abandoned.

TECHNICAL FIELD

The present invention relates to a saturated polyester resin bottle having an exterior decorative coating. More particularly, this invention relates to a saturated polyester resin bottle coated with an appropriate primer layer for providing an adhesion surface for a subsequently applied decorative paint layer.

BACKGROUND OF THE INVENTION

Bottle made of a saturated polyester resin have recently become popular because of their tendency to resist deterioration and to withstand attack of a liquid contained therein. Moreover, saturated polyester resin bottles are widely used because they do not generate poisonous gases when burned. However, one major drawback with such saturated polyester resin bottles is that they are not easily coated with paint or the like to enhance their decorative value. That is, decorative paint coatings on such bottles tend not to stick to the bottles, but instead have the annoying tendency to peel off.

BRIEF SUMMARY OF THE INVENTION

The present invention relates to a saturated polyester resin bottle with a decorative paint coating, and to a method of applying the decorative paint coating to the bottle. In accordance with the invention, a primer layer is applied to the exterior surface of the bottle thereby to smooth the surface thereof. The primer layer is then coated with an undercoat layer which provides a surface for a subsequently applied decorative paint layer. In turn, the decorative paint layer is coated with a protective top coat layer, whereby the several layers combine to firmly adhere the decorative paint layer to the bottle without peeling.

BRIEF DESCRIPTION OF THE DRAWINGS

The accompanying drawings illustrate the invention. In such drawings.

DETAILED DESCRIPTION OF THE INVENTION

Figure 1:
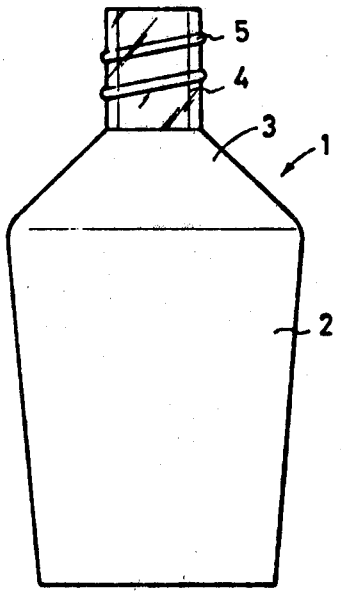
FIG. 1 is a front elevation view showing a saturated polyester resin bottle according to the present invention.
Figure 2:
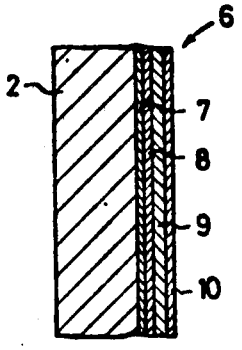
FIG. 2 is a sectional view showing a sectional portion of the bottle of FIG. 1.

The present invention will be described in more detail with reference to the accompanying drawings. A bottle 1 formed of saturated polyester resin includes an enlarged liquid-containing base or trunk portion 2 in the form of a generally upstanding cylinder and bottom wall. A shoulder portion 3 extends upwardly from the trunk portion 2, and terminates in an upwardly extending neck or mouth portion 4. The mouth portion 4 conveniently includes circumferential threads 5 on which a cap (not shown) may be threadably received. According to the invention, the bottle 1 is decorated with a decorative paint coating 6 applied to the exterior surface except for the mouth portion 4.

The decorative paint coating 6 is applied to the bottle 1 as follows. First, the bottle is cleaned to remove dirt, residue, and the like from the exterior bottle surfaces. This cleaning step is achieved preferably by immersing the bottle 1 in a suitable fluoric solvent, and then subjecting the immersed bottle to an ultrasonic treatment for about five minutes.

After the cleaning step, a chlorinated primer layer 7 which is a chlorinated polyolefin is applied to the exterior surfaces of the bottle 1 and is subjected to a natural seasoning for about two or three minutes. After seasoning, the primer layer 7 can be coated with a smooth surface adapted for forming a base for a decorative paint layer. This smooth surface takes the form of an undercoat layer 8 of a suitable acrylic. The undercoat layer 8 is allowed to evaporate, and the bottle is then dried at a temperature of about 55° C. for about two or three hours. This undercoat layer 8 thus prepared acts as a surface for ensuring a firm adhesion interface between the primer layer 7 and a subsequently applied decorative paint layer.

The cured and dried undercoat layer 8 is coated with a decorative paint layer 9 such as a polarized pearl layer prepared by adding a transparent or blue pigment to titanium nitride. The paint layer 9 firmly adheres to the undercoat 8 which in turn adheres to the primer layer 7, such that the layers 7, 8, and 9 together form a decorative paint coating substantially free from undesirable peeling. The polarized paint layer 9 may then be coated with a protective topcoat layer 10 comprising a mixture of urethane liquids. In practice, the topcoat layer 10 is dried at a temperature of about 55° C. for about twelve hours, and serves to cover and protect the paint layer 9 further against peeling, and to enhance the visual appearance of the bottle surface finish.

If desired, the decorative coating process described herein may be adapted to allow letters or the like to be printed on the trunk portion 2 of the bottle 1. More specifically, masking letters of the like may be applied to the trunk portion 2 prior to application of the primer layer 7. After the decorative coating layers are applied, the masking letters may then be peeled off, thereby yielding a decorative lettered pattern or the like appearing on the bottle 1.

As has been described herein, according to the present invention, a decorative bottle of saturated polyester resin is produced by having its outer surface coated consecutively with a primer layer 7, an undercoat layer 8, and further with a decorative paint layer 9. With this arrangement of layers, the decorative paint layer 9 firmly adheres to the bottle 1 and thus is prevented from peeling off. Moreover, the decorative paint layer 9 may be further protected and enhanced by a top coat layer 10 forming the outermost surface of the bottle 1. Still further, the strength of the bottle 1 is advantageously improved due to the application of the four above-specified layers comprising the decorative coating 6.

We claim:

1. A paint-coated bottle formed of a saturated polyester resin, comprising: a chlorinated primer layer applied to the exterior surface of the bottle; an acrylic undercoat layer applied to said primer layer; and a decorative paint layer applied to said undercoat layer, said paint layer being prepared by adding a pigment to titanium nitride.

2. A bottle as set forth in claim 1, wherein said decorative paint layer is formed form a polarized pearl paint which is prepared by adding a transparent or blue pigment to titanium nitride.

3. A bottle as set forth in claim 1 or 2, wherein said primer layer consists of a chlorinated polyolefin.

* * * * *